US006582575B2

(12) United States Patent
Miyatake et al.

(10) Patent No.: US 6,582,575 B2
(45) Date of Patent: Jun. 24, 2003

(54) COATING FILM-FORMING METHOD

(75) Inventors: Shinji Miyatake, Kanagawa-ken (JP); Akira Tominaga, Kanagawa-ken (JP); Hidehiko Haneishi, Kanagawa-ken (JP)

(73) Assignee: Kansai Paint Co., Ltd., Hyogo-ken (JP)

( * ) Notice: Subject to any disclaimer, the term of this patent is extended or adjusted under 35 U.S.C. 154(b) by 149 days.

(21) Appl. No.: 09/934,565

(22) Filed: Aug. 23, 2001

(65) Prior Publication Data

US 2002/0043464 A1 Apr. 18, 2002

(30) Foreign Application Priority Data

Aug. 29, 2000 (JP) ..... 2000-258745

(51) Int. Cl.[7] ..... C25D 13/12
(52) U.S. Cl. ..... 204/488; 204/484
(58) Field of Search ..... 204/484, 488

(56) References Cited

U.S. PATENT DOCUMENTS

| | | | | |
|---|---|---|---|---|
| 2,450,940 | A | 10/1948 | Cowan et al. | |
| 3,403,088 | A | 9/1968 | Hart | |
| 5,000,979 | A | 3/1991 | Cueman et al. | |
| 6,032,871 | A | 3/2000 | Borner et al. | |
| 6,231,738 | B1 * | 5/2001 | December | 204/484 |
| 6,447,931 | B1 * | 9/2002 | Miyatake et al. | 204/484 |
| 6,508,922 | B2 * | 1/2003 | Kimpel | 204/488 |

FOREIGN PATENT DOCUMENTS

| | | |
|---|---|---|
| JP | 12395/70 | 5/1970 |
| JP | 12396/70 | 5/1970 |
| JP | 41994/95 | 2/1995 |
| JP | 324292/97 | 12/1997 |
| JP | 8291/98 | 1/1998 |
| JP | 192439/99 | 7/1999 |
| JP | 200006042 | 6/2000 |

OTHER PUBLICATIONS

Patent Abstracts of Japan Publication No. 61–185358 (Aug. 19, 1986).

British Search Report from applicants' corresponding British patent application.

* cited by examiner

*Primary Examiner*—Kishor Mayekar
(74) *Attorney, Agent, or Firm*—Fisher, Christen & Sabol

(57) ABSTRACT

A coating film-forming method that includes a first step that involves coating a cationic electrodeposition coating composition (A) containing an electrically conducting agent, followed by washing with water and heat curing and drying to form a cured cationic electrodeposition coating film. A second step that involves coating such an anionic electrodeposition coating composition (B). The coating film formed therefrom has a chromatic color or a white color as an achromatic color onto the cured cationic electrodeposition coating film. This is followed by washing with water, and removing water by preheating or air blowing to form a non-cured anionic electrodeposition coating film. A third step that involves coating a topcoating composition (C) thereonto to form a non-cured topcoating film, and heat curing and drying a resulting laminated coating film simultaneously.

6 Claims, 1 Drawing Sheet

COATING FILM-FORMING METHOD

This application has priority benefit of Japanese Patent Application No. 00/258745, filed on Aug. 29, 2000.

BACKGROUND ART (1) Field of the Invention

The present invention relates to a coating film-forming method, more particularly to a coating film-forming method which comprises coating a cationic electrodeposition coating composition containing an electrically conducting agent onto a metal substrate such as an automobile body, followed by curing and drying, coating an anionic electrodeposition coating composition onto a cured coating film to form a non-cured coating film, coating a topcoating composition onto the non-cured coating film to form a non-cured topcoating film, and heat curing and drying a resulting laminated film simultaneously.

The present invention also relates to a coating film-forming method, wherein a coating color of the anionic electrodeposition coating film is the same series of chromatic color in accordance with a hue represented by Mansell color system as a coating color from a topcoating composition coated thereafter.

(2) Description of Background Art

It is known in the art that the cationic electrodeposition used as a paimer coating for an automobile body is applied to one coat electrodeposition coating as well as two coat electrodeposition coating (W coat electrodeposition coating), wherein a first electrodeposition is coated to form a first electrodeposition coating film, followed by coating thereonto a second electrodeposition coating composition having a function different from the first electrodeposition coating film (see Japanese Patent Application Laid-Open Nos. 41994/95, 324292/97, 8291/98, etc.).

For the purpose of satisfying a recent demand of more and more improving an electrodeposition coating film in corrosion resistance and weather resistance, Japanese Patent Application No. 192439/99 teaches a coating film-forming method which comprises coating a cationic electrodeposition coating composition containing an electrically conducting agent to form a cured dry film, followed by coating an anionic electrodeposition coating composition thereonto a form a cured dry film showing good weather resistance.

On the other hand, for the purpose of reducing cost and improving productivity in the automobile body coating, attempts have been made on omitting a curing step by a wet-on-wet coating, omitting an intercoat coating step, or on reducing a coating film thickness. However, for the purpose of satisfying recent demands by users on good finished appearance, whiter appearance, improved chipping resistance, etc., attempts to reduce a pigment concentration in order to ensure opacifying properties and chipping resistance on omitting an intercoat coating and coating film therefrom, and to improve finished appearance by increasing a coating film thickness or the like have been made. Applications of a water-based intercoating or topcoating are considered as an effective means to solve environmental coating problems.

The above case, however, has produced problems required to be solved, for example, reduction in opacifying properties due to reduction in a pigment concentration, increase in cost due to increase in the coating film thickness, and particularly reduction in finished properties due to sagging of a water based topcoating film on a vertical coating along a press line of a door part or around a keyhole part.

SUMMARY OF THE INVENTION

For the purpose of solving the above problems, the present inventers made intensive studies to find out a coating film-forming method according to a two coats-one bake electrodeposition coating (hereinafter may be referred to a W-coat electrodeposition coating), which method comprises coating a cationic electrodeposition coating composition containing an electrically conducting agent, heat curing to form a calionic electrodeposition coating film having a volume resistivity of $10^{12}$ Ω·cm or less, coating an anionic electrodeposition coating composition to form a non-cured anionic electrodeposition coating film, coating thereonto a topcoating composition to form a non-cured topcoating film, and heat curing the resulting laminated film simultaneously.

Preferably, the above coating film-forming method comprises coating an anionic electrodeposition coating composition such that a coating film color according to the anionic electrodeposition coating is the same series of chromatic color in accordance with a hue represented by Mansell color system as that from a topcoating composition to be coated thereafter, or white as an achromatic color to form a non-cured anionic electrodeposition coating film, coating the topcoating composition to form a non-cured topcoating film, and heat curing the resulting laminated film simultaneously.

The wet-on-wet coating of the water based topcoating composition onto the non-cured anionic electrodeposition coating film makes it possible to achieve improvements in finished properties, opacifying properties and anti-chipping properties even in the absence of an intercoating step, and further makes it possible to obtain good sagging resistance, resulting in accomplishing the present invention.

That is, an object of the present invention is to provide a coating film-forming method which is capable of achieving improvements in finished properties, opacifying properties and anti-chipping properties even in the absence of an intercoating step, and capable of obtaining good sagging resistance on the wet-on-wet coating of the water based topcoating composition onto the non-cured anionic electrodeposition coating film.

The present invention provides a coating film-forming method comprising a first step which comprises coating a cationic electrodeposition coating composition (A) containing an electrically conducting agent so that a cured coating film formed therefrom can have a volume resistivity of $10^{12}$ Ω·cm or less onto a metal substrate selected from the group consisting of an automobile body and automobile parts, followed by washing with water and heat curing and drying to form a cured cationic electrodeposition coating film; a second step which comprises coating such an anionic electrodeposition coating composition (B) that a coating film formed therefrom has a chromatic color or a white color as an achromatic color onto the cured cationic electrodeposition coating film, followed by washing with water, and removing water by preheating or air blowing to form a non-cured anionic electrodeposition coating film; and a third step which comprises coating a topcoating composition (C) thereonto to form a non-cured topcoating film, and heat caring and drying a resulting laminated coating film simultaneously, preferably wherein the topcoating composition (C) is such a topcoating composition that a coating film formed therefrom has the same series of chromatic color in accordance with a hue represented by Mansell color system as the color of the anionic electrodeposition coating film or a white color as an achromatic color.

The present invention also relates to the above coating film-forming method, wherein the topcoating composition (C) is a water based solid color topcoating composition (a).

The present invention also relates to the above coating film-forming method, wherein the third step comprises coating a water based metallic base coat (b) to form a non-cured coating film, coating thereonto a clear top coat (c) to form a non-cured coating film, and heat curing and drying a resulting laminated coating film simultaneously.

DETAILED DESCRIPTION OF THE INVENTION

Figure 1:
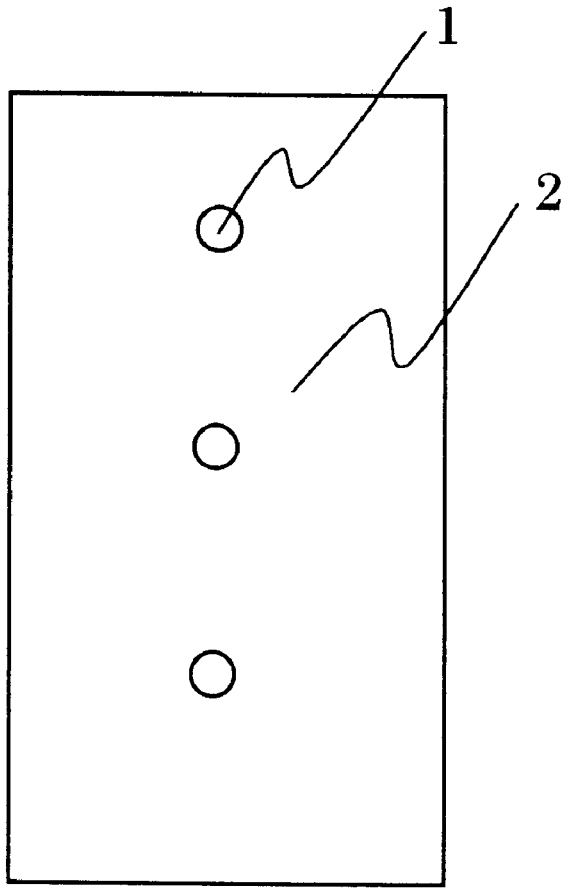
FIG. 1 is a schematic view of a test panel 2 used in a sagging properties test in coating, in which the test panel is a steel sheet having a punched hole 1 of 10 mm in diameter, excemplifying a keyhole in a door part.

Details of the first to third steps, the cationic electrodeposition coating composition (A), anionic electrodeposition coating composition (B), topcoating composition (C), water based solid color topcoating composition (a), water based metallic base coat (b) and clear top coat (c) in the present invention are explained hereinafter respectively. First Step:

A coating substrate used in the first step may include ones having a complicated structure, for example, an automobile body, automobile parts, bag parts, etc. A material of the coating substrate may include metal, preferably an anticorrosive steel plate from the standpoint of anti-corrosive properties.

Examples of the steel plate may include melt galvanized steel plate, electrically galvanized steel plate, electrical zinc-iron bilayer plated steel plate, organocomposite plated steel plate, as well as ones prepared by subjecting a base material such as the above steel plates, cold rolled steel sheet, etc. to optionally a surface-cleaning treatment by an alkali degreasing or the like, followed by a surface treatment such as phosphate process, chromate process or the like.

The cationic electrodeposition coating composition (A) used in the method of the present invention may include any known cationic electrodeposition coating composition without limitation, and may be arbitrarily selected depending on a coating film performances as required.

The cationic electrodeposition coating composition (A) is coated onto a non-treated or treated coating substrate such as metal by an electrodeposition coating, and is a cationic electrodeposition coating composition capable of forming a cured coating film having a volume resistivity of $10^{12}$ Ω·cm or less, and specifically may include a cationic electrodeposition coating composition containing a cationic resin as an essential component and an electrically conducting agent so that the coating film may have a volume resistivity within the above range, and prepared by mixing and dispersing into water.

The cationic resin may include any known resins used in the cationic electrodeposition coating composition, and preferably, for example, a composition comprising a base resin having hydroxyl group and a cationic group, and a crosslinking agent such as a blocked polyisocyanate compound.

The base resin may include, for example, a reaction product of epoxy resin with a cationizing agent, a resin prepared by protonizing a polycondensation product (see U.S. Pat. No. 2,450,940) of polycarboxylic acid with polyamine by use of an acid, a resin prepared by protonizing polyaddition product of a polyisocyanate compound, polyol and mono- or polyamine by use of an acid, a resin prepared by protonizing a copolymer of hydroxyl group and amino group-containing acrylic or vinyl monomers by use of an acid (see Japanese Patent Publication Nos. 12395/70 and 12396/70), a resin prepared by protonizing an addition product of polycarboxylic acid resin with alkylene amine by use of an acid (see U.S. Pat. No. 3,403,088), and the like. Of these, a base resin prepared by reacting an epoxy resin obtained by a reaction between a polyphenol compound and epichlorohydrin with a cationizing agent is particularly preferable from the standpoint of good corrosion resistance.

The epoxy resin has at least two epoxy groups in one molecule, a number average molecular weight in the range of 200 or more, particularly 400 to 4000, and an epoxy equivalent in the range of 190 to 2000, particularly 400 to 1000.

The polyphenol compound used in the preparation of the epoxy resin may include, for example, bis(4-hydroxyphenyl)2,2-propane, 4,4-dihydroxybenzophenone, bis(4-hydroxyphenyl)-1,1-ethane, bis(4-hydroxyphenyl)-1,1-isobutane, bis(4-hydroxy-tert-butylphenyl)-2,2-propane, bis(2-hydroxybutyl)methane, 1,5-dihydroxynaphthalene, bis(2,4-dihydroxyphenyl)methane, tetra(4-hydroxyphenyl)-1,1,2,2,-ethane, 4,4-dihydroxydiphenyl ether, 4,4-dihydroxydiphenylsulfone, phenol novolak, cresol novolak, and the like. The above base resin may be modified with acrylic resin, polybutadiene, alkyd resin, polyester resin, polyamide resin and the like to be used.

The cationizing agent may include an amine compound such as a primary amine, secondary amine, tertiary amine, polyamine, and the like. These cationizing agents may preferably be reacted with all or almost all of epoxy groups in the epoxy resin to form a cationic group such as a secondary amino group, tertiary amino group, quaternary ammonium group and the like. Otherwise, a cationic group may also be prepared by protonizing a basic group formed by a reaction of epoxy group with a basic compound such as ammonia, hydroxyamine, hydrazine, hydroxyethylhydrazine, N-hydroxyethylimidazoline and the like as the cationizing agent by use of an acid.

The hydroxyl group of the base resin is desirable in that a primary hydroxyl group introduced by the reaction thereof with, for example, an alkanolamine usable as a cationizing agent shows a good crosslinking reactivity with the blocked polyisocyanate compound as the crosslinking agent.

The base resin preferably has a hydroxy equivalent of 20 to 5000, particularly 100 to 1000 mg KOH/g, and particularly a primary hydroxy equivalent of 200 to 1000 mg KOH/g. On the other hand, the cationic group may present in such an amount as to be necessary for stably dispersing the base resin into water, preferably in the range of 3 to 200, particularly 10 to 80 mg KOH/g in terms of amine value. The above base resin desirably has no free epoxy group as a rule.

The blocked polyisocyanate compound is a crosslinking agent for three dimensionally crosslinking the base resin, and is such that the isocyanate group of the polyisocyanate compound having at least two isocyanate groups in one molecule is blocked with a blocking agent. Heating of the blocked polyisocyanate compound results dissociation of the blocking agent, followed by regeneration of free isocyanate group, and by a crosslinking reaction thereof with active hydrogen such as hydroxyl group in the base resin.

The polyisocyanate compound is a compound having at least two free isocyanate groups in one molecule, and may include any known ones per se, for example, aromatic diisocyanate such as tolylene diisocyanate, diphenylmethane diisocyanate, xylylene diisocyanate, naphthalene diisocyanate and the like; aliphatic diisocyanate such as trimethylene diisocyanate, tetramethylene diisocyanate, hexamethylene diisocyanate, dimer acid diisocyanate, lysine diisocyante and the like; alicyclic diisocyanate such as methylene bis(cyclohexylisocyanate), isophorone diisocyanate, methylcyclohexane diisocyanate, cyclohexane diisocyanate, cyclopentane diisocyanate and the like; biuret type adducts of the above polyisocyanate, isocyanuric ring type adducts; free isocyanate group-containing urethane prepolymer prepared by reacting the above polyisocyanate with low molecular weight or high molecular weight polyols under an excess amount of isocyanate group, and the like.

The blocking agent may include any known ones per se, for example, phenol, lactam, alcohol, oxime, active methylene, mercaptan, acid amide, imide, amide, imidazole, imine blocking agents, and the like.

A mixing ratio of the base resin and the crosslinking agent such as the blocked polyisocyanate compound may arbitrarily be selected depending on requirement, but is such that, for example, the former is in the range of 50 to 90%, particularly 60 to 80%, and the latter is in the range of 50 to 10%, particularly 40 to 20% based on a total weight of both components respectively.

The base resin and the crosslinking agent are mixed with agitation, followed by neutralizing the cationic group in the base resin with an acid compound such as acetic acid, formic acid, lactic acid, phosphoric acid and the like, and mixing with water to be water-dispersed.

The electrically conducting agent is used to control the volume resistivity of the cured coating film from the cationic electrodeposition coating composition (A) in the range of $10^{12}$ Ω·cm or less, and may include, for example, granular or powdered carbon black, graphite, silver, copper, nickel, tin oxide and the like. These may be used alone or in combination. A mixing amount of the electrically conducting agent is preferably in the range of 1 to 50 parts by weight, particularly 3 to 30 parts by weight per 100 parts by weight of a resin solid content.

The cured coating film of the cationic electrodeposition coating composition (A) used in the present invention has a volume resistivity in the range of $10^{12}$ Ω·cm or less, preferably $10^{8}$ Ω·cm or less. A volume resistivity more than $10^{12}$ Ω·cm may reduce an electrodeposition coating properties of the anionic electrodeposition coating composition (B) on the coating surface thereof, and, even if a coating film may be formed, may reduce smoothness of the resulting coating film.

The volume resistivity is measured in accordance with JIS-K6911-1955, and by using a measuring apparatus, DSM-8103 (Trade name, marketed by Toa Electronics Ltd.).

The cationic electrodeposition coating composition (A) contains a base resin, a crosslinking agent and an electrically conducting agent, and may be prepared by formulating a water based emulsion obtained by neutralizing a cationic group in the base resin with an acid compound such as acetic acid, formic acid, lactic acid, phosphoric acid and the like, followed by dispersing into deionized water, and a pigment paste. Since a coating color is gray or black as the achromatic color so as to opacify a base color of a coating substrate, the pigment paste may be prepared, for example, by mixing a pigment composition comprising a color pigment such as carbon black, titanium white and the like, an extender pigment such as clay, talc, calcium carbonate and the like, and an anti-corrosive pigment such as strontium chromate, lead chromate, lead silicate, aluminum tripolyphosphate, zinc tripolyphosphate, zinc oxide, inorganic bismuth compounds, organic acid-bithmuth compounds, and the like; a resin for use in dispersion, for example, tertiary amine based epoxy resin, quaternary ammonium salt based epoxy resin, tertiary amine based acrylic resin and the like; a neutralyzing agent and deionized water, followed by dispersing in a ball mill, sand mill or the like.

Particularly, the pigment paste may preferably contain a lead-free bismuth-containing compound such as bismuth hydroxide, bismuth lactate and the like as the anti-corrosive pigment without using a harmful substance such as a lead-containing compound.

The electrodeposition coating of the cationic electodeposition coating composition (A) may be carried out without paticular limitations, but preferably under the conditions of a bath temperature in the range of 15 to 35° C., preferably 20 to 30° C., a loading voltage in the range of 100 to 400 V, preferably 200 to 300 V, an energizing time in the range of 30 seconds to 10 minutes, an anode to cathode area ratio (A/C) in the range of 8/1 to 1/8, a distance between anode and cathode in the range of 10 to 200 cm with agitation.

A film thickness of the electrodeposition coating film formed from the cationic electrodeposition coating composition (A) may arbitrarily be selected depending on an intended performance, but preferably may be in the range of 5 to 60 μm, preferably 10 to 40 μm. Completion of the electrodeposition coating may be followed by thoroughly washing with water twice or more by use of a UF filtrate, RO rinsing water, industrial water, deionized water or the like, so that the cationic electrodeposition coating composition (A) may not remain on the surface of a coat-finished product. The above washing with water may be carried out by dipping an automobile body, parts or the like into a rinsing bath, or by spraying.

A coating film formed as above may be heat cured and dried at 140 to 190° C. for 5 to 60 minutes in an electrical hot air dryer or a gas hot air dryer.

Of the cationic electrodeposition coating composition (A), use of a cationic electrodeposition coating composition containing a base resin, which mainly contains epoxy resin, makes it possible to form a coating film showing good corrosion resistance, and use of a cationic electrodeposition coating composition containing a base resin, which mainly contains vinyl copolymer, makes it possible to form a coating film showing good weather resistance.

Of the automobile body, an underfloor of the body may sustain damages due to stepping stones, etc., and consequently, for the purpose of corrosion proof, dustproof, soundproof, heatproof, etc., an under coat solid layer may be applied onto the surface of the underfloor, bag-structural parts., etc., separately from the cationic electrodeposition coating composition. The under coat solid layer may be formed by spraying or the like a sealing agent such as a sealing agent mainly containing vinyl chloride resin, a sealing agent prepared by adding calcium carbonate to epoxy resin-urethane resin system, a sealing agent mainly containing a asbestos-containing asphalt or the like, and by drying at room temperature or heat curing and drying.

The second step comprises coating an anionic electrodeposition coating composition (B) onto the cured cationic electrodeposition coating film, followed by washing with water, and removing water by preheating or air blowing to form a non-cured anionic electrodeposition coating film, and in preferably characterized in that a coating color of the anionic electrodeposition coating composition (B) is the same series of chromatic color in accordance with a hue represented by Mansell color system as the color of a topcoating composition to be coated thereafter, or white as an achromatic color. The anionic electrodeposition coating composition (B) is a water based coating composition comprising a pigment paste and an emulsion.

The pigment paste may be prepared by mixing a pigment, a water based acrylic resin having carboxyl group and hydroxyl group as a dispersing resin, a neutralizing agent and deionized water, followed by dispersing in a ball mill, sand mill or the like.

The pigment to be used may include color pigments, that is, white color pigments such as titanium dioxide, zinc oxide, basic lead sulfate, calcium hydrochloride, zinc phosphate, aluminum phosphate, zinc molybdate, calcium molybdate; blue color pigments including inorganic blue pigments such as prussian blue, ultramarine and cobalt blue, and organic blue pigments such as copper phthalocyanine blue and indanthrone blue; yellow color pigments including inorganic yellow color pigments such as chrome yellow, synthetic yellow iron oxide, transparent iron oxide (yellow), bismuth vanadate, titanium yellow, zinc yellow, strontium chromate and cyanamide lead, and organic yellow color pigments such as monoazo yellow, disazo yellow, isoindolinone yellow, metal complex azo yellow, quinophthalone yellow, isoindolin yellow and benzimidazolone yellow; red color pigments including inorganic red color pigments such as red iron oxide, transparent iron oxide (red) and red lead, and organic red color pigments such as monoazo red, non-substituted quinacridone red, azo lake (manganese salt), fuchsin, anthanslone oranze, dianthraquinonyl red, perylenemalune, perylene red, diketopyrrolopyrrole chrome vermillion and basic lead chromate; green color pigments including inorganic green color pigments such as chrome oxide, and organic green color pigments such as chlorinated phthalocyanine green and brominated phthalocyanine green; other color pigments such as pyrazolone orange, benzimidazolone orange, dioxazine violet, perylene violet, etc.

The extender pigment may include, for example, mica, clay such as kaolin, talc, calcium carbonate, barium sulfate, aluminum powder, zinc powder, pearl mica and the like.

The above emulsion may be prepared by subjecting a neutralized and carboxyl group-containing anionic resin to water dispersion by use of an amine or the like, and may include any known ones used in the known anionic electrodeposition coating composition.

The use of a carboxyl group and hydroxyl group-containing acrylic resin as the anionic resin preferably makes it possible to improve the weather resistance and smoothness of a coating film formed from the anionic electrodeposition coating composition (B). The anionic resin may also include polyester resin, polyurethane resin, vinyl resin and the like, having carboxyl group and hydroxyl group respectively.

Neutralization of carboxyl group in the anionic resin by a neutralizing agent, for example, an organic amine such as ammonia, diethylamine, ethylethanolamine, diethanolamine monoethanolamine, monopropanolamine, isopropanolamine, ethylaminoethylamine, hydroxyethylamine, diethylenetriamine and the like, and alkali metal hydroxide such as caustic soda, caustic potash and the like, and the like makes the composition water-soluble or water-dispersible.

The carboxyl group and hydroxyl group-containing acrylic resin may include a copolymer prepared by subjecting a monomer mixture of carboxyl group-containing unsaturated monomer, hydroxyl group-containing acrylic monomer, and optionally other polymerizable monomer to radical polymerization.

The carboxyl group-containing unsaturated monomer is a compound having at least one carboxyl group and polymerizable unsaturated bond in one molecule respectively, and may include, for example, (meth)acrylic acid, maleic acid, caprolactone-modified carboxyl group-containing (meth) acrylic monomers (Placcel FM1A, Placcel FM4A, Placced FM10A, trade names, marketed by Daicel Chemical Industries, Ltd. respectively), and the like.

The hydroxyl group-containing acrylic monomer is a compound having at least one hydroxyl group and polymerizable unsaturated bond in one molecule respectively, and may include, for example, hydroxyethyl (meth)acrylate, hydroxypropyl (meth)acrylate, hydroxybutyl (meth) acrylate, (poly)ethylene glycol mono(meth)acrylate, (poly) propylene glycol mono(meth)acrylate, reaction products of the above hydroxyl group-containing acrylic monomers with lactone compounds such as β-propiolactone, dimethyl propiolactone, butylolactone, γ-valeroluctcone, γ-caprolactone, γ-caprylolactone, γ-laurylolactone, ϵ-caprolactone, δ-caprolactone and the like, Placcel FM1, Placcel FM2, Placcel FM3, Placcel FA1, Placcel FA2, Placcel FA3 (trade names, marketed by Daicel Chemical Industries, Ltd., caprolactone-modified hydroxy (meth) acrylate esters respectively), and the like.

The other polymerizable monomer is a compound other than the carboxyl group-containing unsaturated monomer and the hydroxyl group-containing acrylic monomer, and having at least one polymerizable unsaturated bond in one molecule, and may include, for example, $C_1$–$C_{18}$ alkyl or cycloalkyl esters of (meth)acrylic acid such as methyl (meth)acrylate, ethyl (meth)acrylate, propyl (meth)acrylate, butyl (meth)acrylate, hexyl (meth)acrylate, octyl (meth) acrylate, lauryl (meth)acrylate, cyclohexyl (meth)acrylate and the like, aromatic polymerizable monomer such as styrene, (meth)acrylamide and derivatives thereof such as (meth)acrylamide, N-butoxymethyl (meth)acrylamide, N-methylol (meth)acrylamide and the like, (meth) acrylonitride compounds, alkoxysilyl group-containing polymerizable monomers such as γ-(meth)acryloxypropyl trimethoxysilane, γ-(meth)acryloxypropylmethyl dimethoxysilane, γ-(meth)acryloxypropyl triethoxysilane, vinyltrimethoxysilane and the like, and the like.

A mixing amount of the carboxyl group-containing unsaturated monomer is preferably in such an amount that an acid value of the copolymer may be in the range of about 10 to 200 mg KOH/g, and is preferably in the range of about 3 to 30% by weight, particularly about 4 to 20% by weight based on a total weight of the monomers. A mixing amount of the hydroxyl group-containing unsaturated monomer may be in such an amount that a hydroxyl value of the copolymer may be in the range of about 30 to 300 mg KOH/g, and is preferably in the range of about 3 to 40% by weight, particularly about 5 to 30% by weight based on a total weight of the monomers.

Of the above other monomers, $C_1$-$C_{18}$ alkyl or cycloalkyl esters of (meth)acrylic acid and the aromatic monomer such as styrene are preferable. A mixing amount of the other monomer is in the range of about 37 to 95% by weight, particularly about 60 to 91% by weight based on a total weight of the monomers.

The above monomer mixture is subjected to a radical copolymerization reaction by the known polymerization method such as the solution polymerization. The resulting acrylic resin suitably has a number average molecular weight in the range of 10000 or less, particularly 4000 to 8000.

A crosslinking agent of the anionic resin component in the anionic electodeposition coating composition (B) may include, for example, melamine resin, blocked polyisocyanate compound, polyoxazoline compound and the like without particular limitations. Of these, melamine resin is particularly preferable.

The melamine resin may include an etherified melamine resin prepared by modifying at least part of methylol groups obtained by reacting melamine with formaldehyde or the like by use of at least one alcohol selected from $C_1$–$C_{10}$ monoalcohol. The above resin may preferably contain mononuclear and poly (2–5) nuclear resins in an amount of 50% by weight or more. The melamine resin may have imino group, methylol group and other functional group therein.

The blocked polyisocyanate compound is such a compound that the isocyanate group of a polyisocyanate compound is blocked with a blocking agent, and may specifically include the polyisocyanate compounds exemplified in the above cationic electrodeposition coating composition (A), and is such that heating thereof dissociates the blocking agent, followed by regeneration of free isocyanate group, and a crosslinking reaction of the free isocyanate group with an active hydrogen such as hydroxyl group in the base resin of the anionic electrodeposition coating composition (B).

A mixing ratio of the anionic resin to the crosslinking agent is such that the former is in the range of 50 to 90% by weight particularly 60 to 80% by weight, and the latter is in the range of 50 to 10% by weight, particularly 40 to 20% by weight based on a total solid content weight of both components.

Particularly, in the present invention, an anionic electrodeposition coating composition (B) containing an acrylic resin having carboxyl group and hydroxyl group, and a melamine resin in the above mixing ratio is particularly preferable.

The anionic electrodeposition coating composition (B) may contain, in addition to the above components, additives for use in the coating composition, for example, pigments, anti-settling agents, hydrophilic organic solvents and the like. A mixing amount of the pigment is in the range of 1 to 250 parts by weight, particularly 3 to 150 parts by weight per 100 parts by weight of a total solid content of the anionic resin and crosslinking agent.

An anionic electrodeposition coating may be carried out by a process which comprises dipping a coating object prepared by coating a cationic electrodeposition coating composition (A), as an anode into an anionic electrodeposition coating composition (B) bath controlled at a pH of 6 to 9, preferably 6.5 to 8, a bath solid content of 3 to 40% by weight, preferably 5 to 25% by weight, and a bath temperature of 15 to 40° C., preferably 15 to 30° C., followed by energizing a direct current under a predetermined voltage of 1 to 400V, or by energizing a current of 1 to 400 mA under a predetermined voltage, wherein a predetermined voltage or current may be energized from the beginning, or a voltage or current may slowly be increased up to a predetermined voltage or current in 1 to 30 seconds. An energizing time may suitably be in the range of 30 seconds to 5 minutes. A cured coating film thickness may be in the range of 5 to 100 $\mu$m, particularly 20 to 60 $\mu$m.

The third step comprises coating a topcoating composition (C) onto a non-cured anionic electrodeposition coating film to form a non-cured topcoating film, and heat curing and drying a resulting laminated coating film simultaneously. The topcoating composition (C) may include solvent based, water based and powder coating compositions, but preferably may include the water based coating composition from both standpoints of reduction in volatile organic compounds (hereinafter may simply be referred to VOC, boiling points in the range of 50–260° C. defined by WHO) and finished properties.

A water based solid color topcoating composition (a) as the topcoating composition (C) may be coated, followed by heat curing (hereinafter may be referred to as one coat one bake method, or 1C1B).

As another embodiment of the third step, formation of the non-cured anionic electrodeposition coating film is followed by coating a water based metallic base coat (b) to form a non-cured coating film, coating thereonto a solvent based high solid clear top coat (c) to form a non-cured coating film, and heat curing and drying a resulting laminated coating film simultaneously (hereinafter may be referred to as two coats one bake method, or 2C1B).

The water based solid color topcoating composition (a) may include combinations of base resins, such as acrylic resin, polyester resin, alkyd resin, urethane resin and the like with crosslinking agents such as melamine resin, urea resin, (blocked)polyisocyanate compounds and the like, and may be dispersed into water to be used.

The color pigment used herein may include organic pigments and inorganic pigments as used in the cationic electrodeposition coating composition. These may be used alone or in combination. A coating method of the water based solid color topcoating composition (a) may include a spray coating, electrostatic coating and non-electrostatic coating. Heat curing may be carried out under the conditions of a temperature of 120 to 150° C. for 20 to 40 minutes.

The water based metallic base coat (b) is a heat-curable coating composition containing a resin component, color pigment, organic solvent, and optionally extender pigments, other additives used in the coating composition.

The above resin component may include combinations of base resins such as acrylic resin, polyester resin, alkyd resin, urethane resin and the like with crosslinking agents such as melamine resin, urea resin, (blocked)polyisocyanate compounds and the like, and may be dissolved or dispersed into water to be used.

The color pigment used herein may include those used in the cationic electrodeposition coating composition, for example, titanium white, which is a white pigment mainly containing titanium dioxide, and having a particle size in the range of 0.2 to 0.35 $\mu$m, particularly 0.25 to 0.30 $\mu$m.

The above color pigment may also include an aluminumflake, which is a scaly metal aluminum, and has a thickness in the range of 0.1 to 1.0 $\mu$m, particularly 0.2 to 0.5 $\mu$m, a particle size in the range of 1 to 20 $\mu$m, and an average particle size in the range of 10 $\mu$m or less.

The above color pigment may also include a titanium oxide-coated scaly mica, i.e. white mica or silver mica, having a maximum diameter in the range of 5 to 60 $\mu$m, particularly 5 to 25 $\mu$m, and a thickness in the range of 0.25 to 1.5 $\mu$m, particularly 0.5 to 1 $\mu$m.

A mixing amount of titanium oxide-coated scaly mica may not particularly be limited, but may be in the range of 3 to 20 parts by weight, particularly 7 to 13 parts by weight per 100 parts by weight of a total solid content of the resin component. The above color pigment may optionally include silver plated glass flake, titanium-coated graphite, metal titanium flake, plate-like iron oxide, phthalocyanine flake and the like.

The water based metallic base coat (b) may be coated by a coating method such as electrostatic coating, air spraying, airless spraying and the like so as to have a cured film thickness in the range of 5 to 20 μm.

The clear top coat (c) is a coating composition mainly containing a resin and organic solvent, and optionally containing color pigments and other additives used in the coating composition in such an amount as not to lose transparency of the coating film, and capable of forming a colorless or color transparent coating film. The resin used in the clear top coat may preferably include a heat-curable resin, and specifically combinations of base resins such as acrylic resin, polyester resin, alkyd resin, urethane resin and the like having a crosslinkable functional group such as hydroxyl group, carboxyl group, epoxy group and the like respectively with crosslinking agents such as melamine resin, urea resin, (blocked) polyisocyanate compounds, carboxyl group-containing compounds (or resins), epoxy group-containing compounds (or resins) and the like.

The clear top coat (c) may be coated onto a non-cured coating film of the water based metallic base coat (b) by a coating method such as an electrostatic coating, air spray coating, airless spray coating and the like so as to form a cured coating film having a film thickness in the range of 10 to 100 μm. Formation of a coating film from the clear top coat (c) may be carried out by diluting with a solvent so as to show a viscosity suitable for coating, followed by coating onto a coating substrate by spray coating, electrostatic coating, non-electrostatic coating and the like.

A cured coating film formed from the water based metallic base coat (b) has a film thickness in the range of 10 to 30 μm, preferably 15 to 20 μm, and a cured coating film formed from the solvent based high solid clear top coat has a film thickness in the range of 20 to 60 μm, preferably 30 to 50 μm, without particular limitations respectively.

According to the present invention, a cationic electrodeposition coating composition containing an electrically conducting agent is coated onto a metal substrate, followed by washing with water, heat curing to form a cured cationic electrodeposition coating film, coating an anionic electrodeposition coating composition thereonto to form a non-cured anionic electrodeposition coating film, coating thereonto a water based topcoating composition to form a non-cured topcoating film, and heat curing the resulting laminated film simultaneously to obtain a cured laminated film, wherein preferably the anionic electrodeposition coating composition is such that a coating color of the anionic electrodeposition coating film has the same series of chromatic color in accordance with a hue represented by Mansell color system or white color.

The wet-on-wet coating of the water based topcoating composition onto the non-cured anionic electrodeposition coating film makes it possible to achieve improvements in finished properties, opacifying properties and chipping resistance even in the absence of an intercoating step, and further makes it possible to obtain good sagging resistance.

EXAMPLE

The present invention will be explained more in detail by the following Examples, in which "part" and "%" represent "part by weight" and "% by weight" respectively. The present invention should not be limited these Examples.

Preparation Example 1

Preparation of Pigment Paste for Use in Cationic Electrodeposition Coating

To a mixture of 5.88 parts (solid content 5 parts) of tertiary amine-neutralized dispersing resin having a solid content of 85% and 1.4 parts of 10% acetic acid was added, followed by mixing with agitation, adding 22 parts of titanium white, 10 parts of Vulcan XC72 (Electrically conducting agent, electrically conductive carbon black, trade name, marketed by Cabot Corporation), 2 parts of bismuth hydroxide, and 3 parts of dioctyltinoxide, and dispersing in a ball mill for 40 hours to obtain a 50% pigment paste for use in cationic electrodeposition coating.

Preparation Example 2

Preparation of Amine-Added Epoxy Resin (d) for Use in Cationic Electrodeposition Coating A reactor was charged with 1010 g of Epikote 828 EL (Epoxy resin, trade name, marketed by Oil Shell Epoxy Co., Ltd.), 390 g of Bisphenol A, and 0.2 g of dimethylbenzylamine, followed by reacting at 130° C. to such an extent that an epoxy equivalent may be 800, adding 260 g of ε-caprolactone and 0.03 g of tetrabutoxytitanium, heating up to 70° C., carrying out sampling with time keeping at that temperature tracing an amount of non-reacted ε-caprolactone by an infrared spectral measurement until a degree of conversion reaches 98% or more, cooling down to 120° C., adding 160 g of diethanolamine and 65 g of methylisobutyl diketiminized product of diethylenetriamine, reacting at 120° C. for 4 hours, and adding 420 g of butylcellosolve to obtain an amine-added epoxy resin (d) having an amine value of 58 and a resin solid content of 80%.

Preparation Example 3

Preparation of (Blocked) Polyisocyanate Compound (e) for Use in Cationic Electrodeposition Coating A reactor was charged with 250 g of MDI (4,4'-diphenylmethane diisocyanate) and 44 g of methylisobutyl ketone, followed by heating up to 70° C., slowly adding 146 g of methyl acetoamide, heating up to 90° C., and carrying out sampling with time keeping at that temperature until no absorption due to a non-reacted isocyanate compound is observed by an infrared spectral measurement to obtain a (blocked) polyisocyanate compound (e) having a solid content of 90%.

Preparation Example 4

Preparation of Clear Emulsion for Use in Cationic Electrodeposition Coating

A reactor was charged with 87.5 parts (solid content 70%) of the amine-added epoxy resin (d), 33.3 parts (solid content 30 parts) of (blocked) polyisocyanate compound (e) (alkohol-blocked phenylene diisocyanate), 2.5 parts of liquid organotin and 8.2 parts of 10% formic acid, followed by uniformly stirring, and dropping 184.1 parts of deionized water over about 15 minutes under strong agitation to obtain a clear emulsion for use in cationic electrodeposition coating having a solid content of 32.0%.

Preparation Example 5

Preparation of Cationic Electrodeposition Coating Composition (A)

A mixture of 318.5 parts of 32% clear emulsion for use in cationic electrodeposition coating, 70 parts of 50% pigment paste for use in cationic electrodeposition coating and 296 parts of deionized water was prepared to obtain a cationic electrodeposition coating composition (A) having a solid content of 20%.

Preparation Example 6

Preparation of Acrylic Resin (f) for Use in Anionic Electrodeposition Coating

Acrylic resin solution: A mixture of 15 parts of styrene, 38 parts of methyl methacrylate, 15 parts of n-butyl acrylate, 10 parts of ethyl acrylate, 15 parts of 2-hydroxyethyl acrylate, 7 parts of acrylic acid and 7 parts of azobisdimethylvaleronitrile was dropped into 55 parts of isopropyl alcohol at 80° C. over 3 hours, followed by keeping that time for one hour, dropping one part of azobisdimethylvaleronitrile and 13 parts of butyl cellosolve, and reacting at 80° C. for 4 hours to obtain an acrylic resin (f) used in an anionic electrodeposition coating, and having a solid content of 59%, an acid value of 55 mg KOH/g, a number average molecular weight of 6000 and a hydroxyl value of 73 mg KOH/g.

Preparation Example 7

Preparation of Pigment Paste No. 1 for Use in Anionic Electrodeposition Coating

A mixture of 5 parts (solid content) of acrylic resin (f), 17 parts of titanium white, 0.3 part of carbon black, 5 parts of clay based extender pigment, triethylamine in an amount corresponding to 1.0 neutralization equivalent and deionized water was prepared, followed by dispersing in a ball mill to obtain a 50% pigment paste No. 1 for use in an anionic electrodeposition coating.

Preparation Examples 8–9

Preparation of Pigment Pastes Nos. 2–3 for Use in Anionic Electrodeposition Coating Preparation Example 7 was duplicated except that respective formulations as shown in Table 1 were used to obtain Pigment Pastes Nos. 2 and 3 for use in anionic electrodeposition coating.

TABLE 1

| | | No. 1 | No. 2 | No. 3 |
|---|---|---|---|---|
| 59% Acrylic resin (f) | | 8.47 (5) | 8.47 (5) | 8.47 (5) |
| Triethylamine | | amount corresponding to 1.0 equivalent | | |
| Deionized water | | amount to control solid content | | |
| Color pigment | Titanium white | 14 | 22.3 | |
| | Carbon black | 0.3 | | 0.1 |
| | Copper phthalocyanine blue | | | 15.2 |
| Purified clay | | 8 | 8 | 8 |
| 50% Pigment paste | | 54.6 (27.3) | 54.6 (27.3) | 54.6 (27.3) |

Preparation Example 10

Preparation of Enulsion for Use in Anionic Electrodeposition Coating Composition A mixture of 118.6 parts (70 parts as solid content) of acrylic resin (f), 52.6 parts (30 parts as solid content) of Nikalac MX430 (Trade name, melamine resin, marketed by Sanwa Chemical Co., Ltd.), triethylamine in an amount corresponding to a 0.7 neutralization equivalent, 1.0 part of dinonylnaphthalene sulfonic acid as an acid catalyst and deionized water was prepared to obtain an emulsion used in an anionic electrodeposition coating composition and having a solid content of 32%.

Preparation Examples 11–13

Formulations containing 312.5 parts (100 parts as solid content) of the above emulsion used in the anionic electrodeposition coating composition and having a solid content of 32% and 60 parts (30 parts as solid content) of 50% pigment pastes Nos. 1–3 for use in the anionic electrodeposition coating respectively were prepared, followed by adding deionized water for diluting to obtain anionic electrodeposition coating compositions B1 to B3 having a solid content of 20% respectively.

Preparation Example 14

Preparation of Acrylic Emulsion (g) for Use in Water Based Topcoating Composition A 2-liter glass flask equipped with a stirrer, thermometer and cooling coil was charged with 300 parts of deionized water and one part of sodium dodecybenzene sulfonate, followed by replacing air therein by nitrogen, heating up to 82° C. with agitation for dissolving. Separately, a vessel was charged with 320 parts of deionized water, 50 parts of sodium dodecylbenzene sulfonate and 2 parts of peroxo-2-ammonium sulfate, followed by fully stirring and whipping, adding monomer-mixed solution having the following monomer composition and stirring to obtain an emulsified product. The emulsified product was continuously dropped into the above reactor over 4 hours, followed by stirring at 82° C. for 2 hours and cooling down to 40° C. to obtain an acrylic emulsion (g) having a solid content of 50% by weight and used in a water based topcoating composition.

Preparation Example 15

Preparation of Aqueous Acrylic Resin Solution (h)

A reactor was charged with 60 parts of butylcellosolue and 15 parts of isobutyl alcohol, followed by heating at 115° C. under nitrogen atmosphere, adding at that temperature a mixture of 26 parts of n-butyl acrylate, 47 parts of methyl methacrylate, 10 parts of styrene, 10 parts of 2-hydroxyethyl methacrylate, 6 parts of acrylic acid and one part of azoisobutylonitrile over 3 hours, aging at that temperature for 30 minutes, adding a mixture of one part of azobisisobutylonitrile and 115 parts of butylcellosolve over one hour, aging for 30 minutes, neutralizing with dimethyl ethanolamine in an equivalent, and adding deionized water to obtain an aqueous acrylic resin solution (h) having a solid content of 50%.

Preparation Example 16

Preparation of Pigment Paste No. 1 for Use in Topcoating

A mixture of 10 parts (5 parts as solid content) of the acrylic emulsion (g), 60 parts of titanium white, triethylamine in an amount of 1.0 neutralization equivalent and deionized water was dispersed to obtain a pigment paste No. 2 having a solid content of 30% and used in the topcoating.

Preparation Example 17

Preparation of Pigment Paste No. 3 for Use in Topcoating

A mixture of 10 parts (5 parts as solid content) of the acrylic emulsion (g), 20 parts of copper phthlocyanine blue, 0.1 part of carbon black, triethylamine in an amount of 1.0 neutralization equivalent and deionized water was dispersed to obtain a pigment paste No. 3 having a solid content of 30% and used in the topcoating.

Preparation Example 18

Preparation of Pigment Paste No. 4 for Use in Topcoating

A mixture of 10 parts (5 parts as solid content) of acrylic emulsion (g), 15 parts of copper phthalocyanine blue, 0.1 part of carbon black, triethylamine in an amount of 1.0 neutralization equivalent and deionized water was dispersed to obtain a pigment paste No. 4 having a solid content of 30% and used in a topcoating.

Preparation Example 19

Preparation of Pigment Paste No. 5 for Use in Topcoating

A vessel was charged with 10 parts (5 parts as solid content) of acrylic emulsion (g), 17 parts of MG-51 (Aluminum pigment paste having a metal content of 66.3%, trade name, marketed by Asahi Chemical Industry Co., Ltd.), 15 parts of copper phthalocyanine blue and 20 parts of butylcellosolve, followed by mixing and dispersing to obtain a pigment paste No. 5 having a solid content of 30% and used in a topcoat.

Preparation Example 20

Preparation of Pigment Paste No. 6 for Use in Topcoating

A vessel was charged with 10 parts (5 parts as solid content) of acrylic emulsion (g), 17 parts of MG-51 (Aluminum pigment paste having a metal content of 66.3%, trade name, marketed by Asahi Chemical Industry Co., Ltd.), 10 parts of copper phthalocyanine blue and 20 parts of butylcellosolve, followed by mixing and dispersing to obtain a pigment paste No. 6 having a solid content of 30% and used in a topcoat.

Respective formulations of pigment pastes for use in topcoating are shown in Table 2.

TABLE 2

| | solid color coating | | | | metallic color coat | |
|---|---|---|---|---|---|---|
| | No. 1 | No. 2 | No. 3 | No. 4 | No. 5 | No. 6 |
| Acrylic emulsion (g) | 10 (5) | 10 (5) | 10 (5) | 10 (5) | 10 (5) | 10 (5) |
| Titanium white | 80 | 60 | | | | |
| Copper phthalocyamine blue | | | 20 | 15 | 15 | 10 |
| Carbon black | | | 0.1 | 0.1 | | |
| 66.3% Aluminum paste | | | | | 17 (11.3) | 15 (9.9) |
| Triethylamine | amount corresponding to 1.0 neutralization equivalent | | | | | |
| Deionized water | amount to control solid content | | | | | |
| 30% Pigment paste | 283 (85) | 217 (65) | 83.6 (25.1) | 67 (20.1) | 104 (31.3) | 83 (24.9) |

Preparation Examples 21–26

Preparation of Water Based Topcoating Compositions No. 1 to No. 6

A mixture of 60 parts (30 parts as solid content) of acrylic emulsion (g) having a solid content of 50%, 30 parts of Staphyloid WD-200 (Trade name, marketed by Takeda Chemical Industries, Ltd., HMDI-MEK oxime blocked crosslinking agent), 60 parts (30 parts as solid content) of aqueous acrylic resin solution (h), 283 parts (85 parts as solid content) of pigment paste No. 1 having a solid content of 30% by weight and used in topcoating, and deionized water was well dispersed by use of a disper to obtain a water based topcoating composition No. 1 having a solid content of 30% by weight.

Respective formulations of topcoating compositions No. 1 to No. 6 are shown in Table 3. Of these, topcoating compositions No. 5 and No. 6 were coated, followed by setting for 7 minutes, and coating Magicron HK-4 (Trade name, marketed by Kansai Paint Co., Ltd., solvent-based acrylic-melamine based clear top coat coating composition).

TABLE 3

| | No. 1 | No. 2 | No. 3 | No. 4 | No. 5 | No. 6 |
|---|---|---|---|---|---|---|
| 50% Acrylic emulsion (g) | 60 (30) | 60 (30) | 60 (30) | 60 (30) | 60 (30) | 60 (30) |
| Staphyloid WD-200 | 30 (30) | 30 (30) | 30 (30) | 30 (30) | 30 (30) | 30 (30) |
| Aqueous acrylic resin solution (h) | 60 (30) | 60 (30) | 60 (30) | 60 (30) | 60 (30) | 60 (30) |
| Pigment paste | solid color coating | | | Metallic color coat | | |
| | No. 1 | No. 2 | No. 3 | No. 4 | No. 5 | No. 6 |

Example 1

A first step: A test panel consisting of a cold rolled steel sheet (70×150×0.8 mm) having three punched holes, chemically treated with a Palbond #320 (trade name, marketed by Nihon Parkerizing Co., Ltd., zinc phosphate treating agent) and exemplifying a keyhole in a door part, was used as a coating substrate. A cationic electrodeposition coating composition (A) containing an electrically conducting agent was coated onto the test panel so as to be a coating film thickness of 20 $\mu$m under the conditions of a bath temperature of 28° C. and a coating voltage of 250 V, followed by washing with water to remove non-coated portion of the cationic electrodeposition coating composition (A), and heat curing at 170° C. for 20 minutes by use of an electrically heating dryer to obtain a cationic electrodeposition coating film.

A second step: Onto the above cationic electrodeposition coating film was coated an anionic electrodeposition coating composition (B2) showing a white coating color so as to be a coating film thickness of 30 $\mu$m under the conditions of a bath temperature of 28° C. and a coating voltage of 250 V, followed by washing with water to remove non-coated portion of the anionic electrodeposition coating composition (B2), and air blowing for 10 minutes to remove water and to obtain a non-cured anionic electrodeposition coating film.

A third step: Onto the non-cured anionic electrodeposition coating film was coated a topcoating composition (1) so as to be a film thickness of 35 $\mu$m, and heat curing the resulting laminated film at 140° C. for 20 minutes to obtain a coating test panel for film performance tests. Details of coating compositions, coating steps and test results are shown in Table 4.

Examples 2–4

Example 1 was duplicated except that coating compositions, coating steps and test results are as shown in Table 4.

Comparative Example 1

A first step: A test panel consisting of a cold rolled steel sheet (70×150×0.8 mm) having three punched holes, chemically treated with a Palbond #3020 (trade name, marketed by Nihon Parkerizing Co., Ltd., zinc phosphate treating agent) and exemplifying a keyhole in a door part, was used as a coating substrate. A cationic electrodeposition coating composition(A) containing an electrically conducting agent was coated onto the test panel so as to be a coating film thickness of 20 μm under the conditions of a bath temperature of 28° C. and a coating voltage of 250 V, followed by washing with water to remove non-coated portion of the cationic electrodeposition coating composition (A), and heat curing at 170° C. for 20 minutes by use of an electrically heating dryer to obtain a cationic electrodeposition coating film.

A second step: Instead of carrying out the second step as in Examples, the following intercoat coating step was carried out.

The intercoat coating step: Onto the cured cationic electrodeposition coating film was coated a water based intercoat coating composition WP-404N3 (Trade name, marketed by Kansai Paint Co., Ltd., polyester resin intercoat coating composition), followed by setting for 10 minutes to form a non-cured intercoat coating film.

A third step: Onto the non-cured intercoat coating film was coated by a wet-on-wet coating method the topcoating coating composition (1) so as to be a film thickness of 35 μm, followed by heat curing the resulting laminated film at 140° C. for 20 minutes by use of an electrically heating dryer to obtain a coating test panel to be used for film performance tests. Test results are shown in Table 4.

Comparative Examples 2–5

Experiments were carried out according to the coating compositions, coating steps and heat curing as shown in Table 4 respectively to obtain respective coating test panels. Test results are shown in Table 4.

TABLE 4

| Coating step | | Example 1 | Example 2 | Example 3 | Example 4 | Comp. Ex. 1 | Comp. Ex. 2 | Comp. Ex. 3 | Comp. Ex. 4 | Comp. Ex. 5 |
|---|---|---|---|---|---|---|---|---|---|---|
| Electro-deposition coating step | first step: cationic electrode position coating composition | (A) | (A) | (A) | (A) | (A) | (A) | (A) | (A) | (A) |
| | coating color | gray | gray | gray | gray | gray | gray | gray | gray | gray |
| | film thickness | 20 μm | 20 μm | 20 μm | 20 μm | 20 μm | 20 μm | 20 μm | 20 μm | 20 μm |
| | heat curing temperature (° C.) | 170° C.-20 minutes | 170° C.-20 minutes | 170° C.-20 minutes | 170° C.-20 minutes | 170° C.-20 minutes | 170° C.-20 minutes | 170° C.-20 minutes | 170° C.-20 minutes | 170° C.-20 minutes |
| | second step: anionic electrodeposition coating composition | (B2) | (B2) | (B3) | (B3) | | (B1) | (B1) | (B3) | (B3) |
| | coating color | white | white | blue | blue | | gray | gray | gray | gray |
| | film thickness | 30 μm | 30 μm | 30 μm | 30 μm | | 30 μm | 30 μm | 30 μm | 30 μm |
| | heat curing temperature (° C.) | — | — | — | — | | 140° C.-20 minutes | 140° C.-20 minutes | 140° C.-20 minutes | 140° C.-20 minutes |
| Intercoat Coating Step | intercoat coating composition | | | | | WPX-404N3 | | | | |
| | coating color | | | | | gray | | | | |
| | film thickness | | | | | 35 μm | | | | |
| | heat curing temperature (° C.) | | | | | — | | | | |
| Topcoat Coating Step | third step: topcoat coating composition | (1) | (2) | (4) | (6) | (1) | (1) | (2) | (3) | (5) |
| | coating color | white | white | blue | blue metallic | white | white | white | blue | blue metallic |
| | film thickness | 35 μm | 35 μm | 35 μm | 10 μm | 35 μm | 35 μm | 35 μm | 35 μm | 10 μm |
| | heat curing temperature (° C.) | 140° C.-20 minutes | 140° C.-20 minutes | 140° C.-20 minutes | — | 140° C.-20 minutes | 140° C.-20 minutes | 140° C.-20 minutes | 140° C.-20 minutes | — |
| | third step: topcoat coating composition | | | | HK-4 | | | | | HK-4 |
| | coating color | | | | clear | | | | | clear |
| | film thickness | | | | 25 μm | | | | | 25 μm |
| | heat curing temperature (° C.) | | | | 140° C.-20 minutes | | | | | 140° C.-20 minutes |
| Test Results | 60° gloss (Note 1) | 93 | 94 | 93 | 94 | 93 | 91 | 90 | 91 | 91 |
| | Anti-chipping properties (Note 2) | 3 | 4 | 3 | 3 | 3 | 2 | 2 | 2 | 2 |
| | Sagging resistance (Note 3) | 3 | 3 | 3 | 3 | 2 | 3 | 3 | 3 | 3 |

Test Method (Note 1) 60° Specular Gloss: A 60° specular gloss is such that reflectances when incident angle and light receiving angle are respectively 60 degrees are measured to be expressed by percentage when taking the gloss of reference surface of specular gloss as 100.

(Note 2) Anti-Chipping Properties: Ground stones (100 g) were sprayed onto the coating test panel by use of Q-G-R gravelometer (Trade name, marketed by Q Panel Co., Ltd.) under the conditions of air pressure of 3.29 m Pa (4 kgf/cm$^2$), 20° C. to apply impact to the coating film, followed by subjecting to a salt spray test in accordance with JIS Z-2371 for 48 hours. Development of rust was evaluated as follows.

4:Excellent (Development of rusts on 70 × 150 mm coating test panel: 3 or less)

3:Good (Development of rusts on 70 × 150 mm coating test panel: 5 or less)

2:Slightly poor (Development of rusts on 70 × 150 mm coating test panel: 6 to 9)

1:Poor (Development of rusts on 70 × 150 mm coating test panel: 10 or more)

(Note 3) Sagging Resistance: A test panel consisting of a steel sheet having a punched hole of 10 mm in diameter exemplifying a keyhole in a door part as shown in FIG. 1 was subjected to respective coating steps to prepare a coating test panel. Topcoat coating compositions in Table 4 were subjected to a vertical coating in the same film thickness as shown in Table 4 to observe sagging of the cured coating film around the punched hole and evaluation was made as follows.

3: Good

2: Sagging of 1 mm or so around the punched hole was observed.

1: Sagging of 2 mm or more around the punched hole was observed.

What is claimed is:

1. A coating film-forming method comprising a first step which comprises coating a cationic electrodeposition coating composition (A) containing an electrically conducting agent so that a cured coating film formed therefrom have a volume resistivity of $10^{12}$ Ω·cm or less onto a metal substrate selected from the group consisting of an automobile body and automobile parts, followed by washing with water and heat curing and drying to form a cured cationic electrodeposition coating film;

a second step which comprises coating such an anionic electrodeposition coating composition (B) that a coating film formed therefrom has a chromatic color or a white color as an achromatic color onto the cured cationic electrodeposition coating film, followed by washing with water, and removing water by preheating or air blowing to form a non-cured anionic electrodeposition coating film; and a third step which comprises coating a topcoating composition (C) thereonto to form a non-cured topcoating film, and heat curing and drying a resulting laminated coating film simultaneously.

2. A method as claimed in claim 1, wherein the topcoating composition (C) is such a topcoating composition that a coating film formed therefrom has the same series of chromatic color in accordance with a hue represented by Mansell color system as the color of the anionic electrodeposition coating film or a white color as an achromatic color.

3. A method as claimed in claim 2, wherein the topcoating composition (c) is a water based solid color topcoating composition (a).

4. A method as claimed in claim 2,wherein the third step comprises coating a water based metallic base coat (b) to form a non-cured coating film, coating thereonto a clear top coat (c) to form a non-cured coating film, and heat curing and drying a resulting laminated coating film simultaneously.

5. A method as claimed in claim 1, wherein the topcoating composition (c) is a water based solid color topcoating composition (a).

6. A method as claimed in claim 1, wherein the third step comprises coating a water based metallic base coat (b) to form a non-cured coating film, coating thereonto a clear top coat (c) to form a non-cured coating film, and heat curing and drying a resulting laminated coating film simultaneously.

* * * * *